US006439944B1

(12) United States Patent
La Fata

(10) Patent No.: US 6,439,944 B1
(45) Date of Patent: Aug. 27, 2002

(54) BUBBLE FORMING DEVICE USING IRIS-LIKE LEAF MECHANISM, AND RELATED METHOD

(76) Inventor: John Edward La Fata, 1559 Spinnaker Dr., Suite 205F, Ventura, CA (US) 93001

( * ) Notice: Subject to any disclaimer, the term of this patent is extended or adjusted under 35 U.S.C. 154(b) by 0 days.

(21) Appl. No.: 09/461,897

(22) Filed: Dec. 15, 1999

Related U.S. Application Data

(60) Provisional application No. 60/112,518, filed on Dec. 15, 1998.

(51) Int. Cl.[7] ..... A63H 33/28
(52) U.S. Cl. ..... 446/15
(58) Field of Search ..... 446/15, 16, 17, 446/18, 19, 20, 21

(56) References Cited

U.S. PATENT DOCUMENTS 4,571,629 A 2/1986 Horio et al.
5,202,721 A 4/1993 Kobayashi et al.
5,325,142 A 6/1994 Depatie et al.
5,557,360 A 9/1996 Kobayashi
5,589,906 A 12/1996 Shimizu

*Primary Examiner*—Derris H. Banks
*Assistant Examiner*—Ali Abdelwahed
(74) *Attorney, Agent, or Firm*—Kelly Bauersfeld Lowry & Kelley LLP

(57) ABSTRACT

A bubble forming apparatus includes aligned first and second rims which cooperatively define a central bubble-forming aperture and which move relative to one another. A plurality of leaves each having a first end pivotally attached to the first rim and a second end pivotally attached to the second rim. The leaves selectively move into and out of the central bubble-forming aperture as the rims move. A housing may be provided which partially encases the first and second rims and defines a channel that directs excess bubble solution to a reservoir through a basin formed at a base of the housing. A handle for the device houses the bubble solution reservoir, which may comprise a bottle of bubble solution secured to the handle. A pump is in fluid communication with the bubble solution reservoir and connected to the actuator such that when the actuator rotatably moves the second rim, the pump is activated to discharge bubble solution onto the leaves.

30 Claims, 4 Drawing Sheets

BUBBLE FORMING DEVICE USING IRIS-LIKE LEAF MECHANISM, AND RELATED METHOD

RELATED APPLICATION

This application claims priority from provisional application Ser. No. 60/112,518 filed Dec. 15, 1998.

BACKGROUND OF THE INVENTION

The present invention relates to bubble forming devices. More particularly, the present invention relates to a bubble forming device which incorporates an iris-like leaf aperture mechanism that creates bubbles of varying number and size depending on the position of the leaves.

Devices which produce bubbles have been known for quite some time. There are a number of differing devices which create bubbles, many of which are hand-held and dipped into a reservoir of bubble forming liquid and then blown across to form the bubbles. The opening structure of the device where the bubble is formed has typically been of a fixed predetermined size and shape. Therefore, the size and shape of the bubbles produced is determined by the fixed opening structure.

These devices suffer other drawbacks. Because they are necessarily dipped into an open reservoir, and also due to the fact that children often are the users of these devices, the contents of the reservoir would often times spill. Not only creating a mess, this also limits the amount of bubbles that can be blown as there is less bubble forming liquid available to use after the spill. The need for dipping also causes the excess liquid to travel from the opening onto the handle and eventually onto the hand of the user. This creates a mess and wastes the bubble forming liquid.

Recently, there have been bubble forming devices developed which produce bubbles by delivering liquid to the bubble forming member rather than by dipping. This is often accomplished by a hand trigger or bellows. However, these devices suffer many of the same disadvantages as dipped devices. The child is limited in manipulating the device as the opening which forms the bubble is of a set shape and size. The excess liquid often runs off the opening structure onto the ground or the device itself, wasting liquid and creating a mess. Occasionally, the bubbles adhere to one another and form a chain of bubbles, known as a lather, which droops towards the ground instead of independently floating in the air as intended.

Thus, what is needed is a bubble forming device which has an opening structure capable of being manipulated to form different sizes and numbers of bubbles. What is also needed is a device that retains excess liquid for future use, keeping the surrounding area and user free of liquid. The present invention fulfills these needs and provides other related advantages.

SUMMARY OF THE INVENTION

The present invention resides in a bubble forming apparatus utilizing an iris-like leaf mechanism to produce bubbles. The device can be manipulated to form different sizes and numbers of bubbles.

The device is generally comprised of aligned first and second rims which cooperatively define a central bubble-forming aperture. An actuator rotatably moves the second rim relative to the first rim. The actuator may comprise a lever connected to an outer edge of the second rim. A plurality of leaves having a generally arcuate configuration each have a first end pivotally attached to the first rim and a second end pivotally attached to the second rim. The leaves are configured so as to selectively move into and out of the central bubble-forming aperture as the second rim is moved relative to the first rim. As the leaves are moved into the central bubble-forming aperture, multiple secondary apertures are formed. At least one of the leaves includes a protrusion which aids in closing the central aperture. The first and second rims form a recess capable of at least partially containing the leaves when the leaves are moved to a fully expanded position.

In its most simple form, the leaves of the device are immersed into a reservoir of bubble solution after the actuator has been triggered, typically by pulling the lever, to cause the second rim to rotate and the leaves to move into the central bubble-forming aperture. A bubble film is created by at least partially moving the leaves out of the central bubble-forming aperture. Multiple secondary apertures are formed as the leaves are moved. An air stream is applied to the bubble film to produce bubbles.

In another preferred embodiment, a housing at least partially encases the first and second rims and defines a channel which directs excess bubble solution to a basin formed at a base of the housing. The basin includes at least one valve for draining the excess bubble solution to a reservoir associated with the device. The device may include a handle which houses the bubble solution reservoir. Alternatively, the bubble solution reservoir may comprise a bottle of bubble solution secured to the handle. A pump is in fluid communication with the bubble solution reservoir and connected to the actuator such that when the actuator rotatably moves the second rim the pump is activated to discharge bubble solution onto the leaves. Tubing is connected to the pump for directing the bubble solution to a predetermined point on the first and second rims allowing the bubble solution to be dispensed onto the leaves.

Bubbles are produced in a similar manner as described above except that the bubble solution is dispensed onto the leaves by pumping bubble solution from the reservoir onto the leaves. Excess bubble solution is drained from the leaves and first and second rims and back into the reservoir. The bubble film is then formed and an air stream is applied to the bubble film to produce bubbles.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
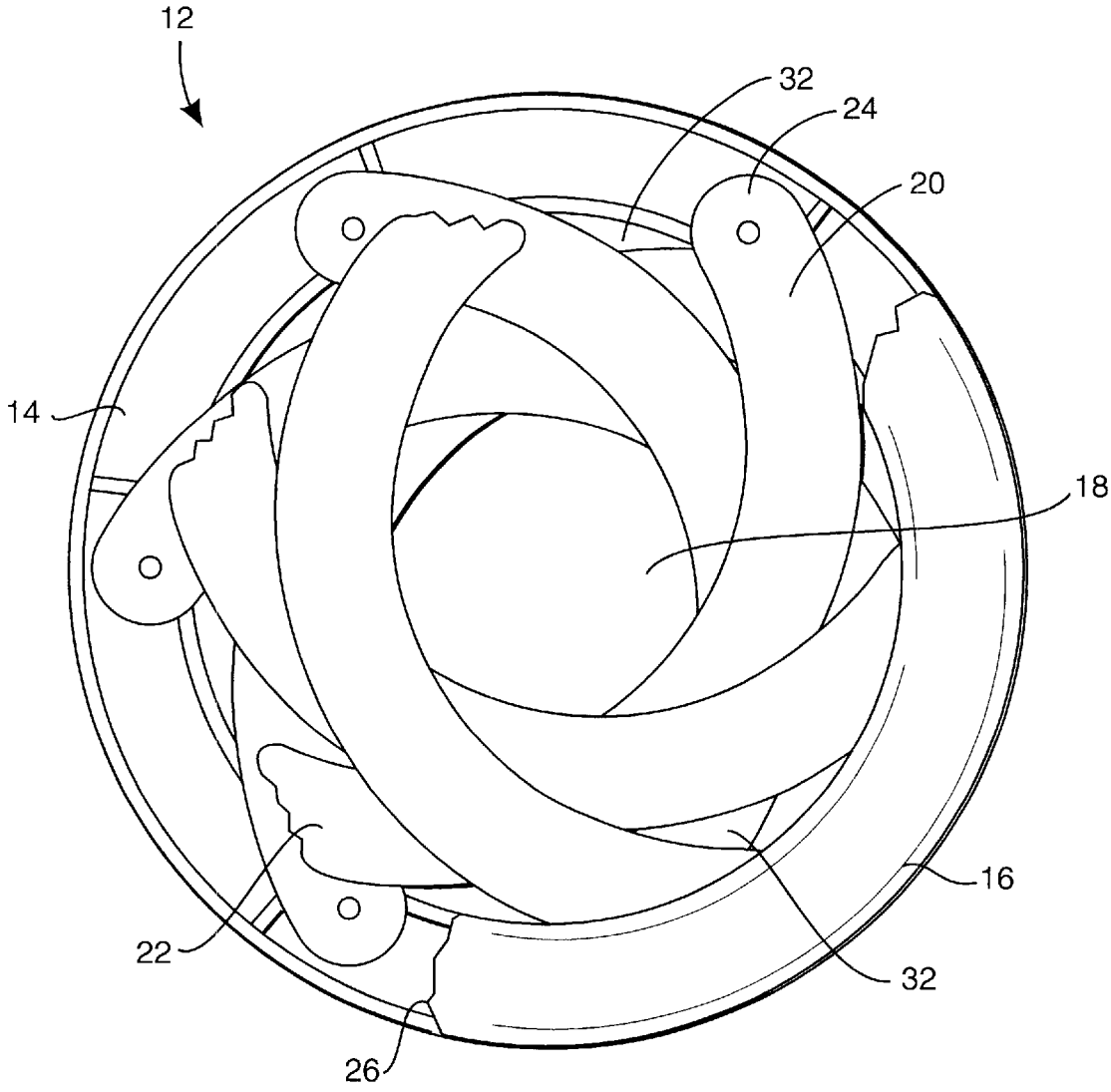
FIG. 1 is a partially fragmented elevational view of an iris-like aperture embodied in the bubble forming devices of the present invention.

As shown in the drawings for purposes of illustration, the present invention is concerned with a bubble forming device 10 having an iris-like leaf aperture mechanism 12 which is able to be manipulated and adjusted to form varying numbers and sizes of bubbles.

In accordance with the invention, and as illustrated in FIG. 1, the iris-like leaf aperture mechanism 12 is comprised of a first rim 14 substantially aligned with a second rim 16 to form a central bubble forming aperture 18. Although the first and second rims 14 and 16 are illustrated in a preferred ring form, they are not limited to such and may comprise any number of shapes having interior apertures. The second rim 16 is rotatably movable relative to the first rim 14. Typically, the first rim 14 is stationarily fixed but may be designed to rotate in an opposite direction as the second rim 16.

A plurality of leaves 20 each have a first end 22 pivotally connected to a predetermined point on the first rim 14 and a second end 24 pivotally connected to a predetermined point on the second rim 16. In this fashion, the leaves 20 move into and out of the central aperture 18 as the second rim 16 is rotated relative to the first rim 14. A recess 26 is formed between the first and second rims 14 and 16 which at least partly accepts the leaves 20 in their fully expanded and outward position.

The leaves 20 are generally arcuate in shape and relatively thin so as to frictionally overlap and move across one another. The leaves are preferably comprised of transparent or translucent plastic which may be colored so as to create a kaleidoscope effect of varying colors as the leaves 20 are moved into and out of the central aperture 18. At least one of the leaves 20 preferably includes a protrusion 28 which acts to fully close the central aperture 18 when the leaves 20 are in their fully closed position. Without the protrusion 28, a small opening is left near the center of the central aperture 18. While a bubble film may still be produced with such a small opening if the bubble solution cascades over or otherwise fills the small opening, fully closing the central aperture 18 facilitates producing a bubble film when the leaves 20 are coated with bubble solution.

In use, the second rim 16 is rotated relative to the first rim 14 by triggering an actuator 30. The actuator 30 may comprise a manual dial, lever, electronic switch or any appropriate means of rotating the second rim 16. Once the second rim 16 has been moved to a point where the leaves 20 are in a fully closed position, the leaves 20 are covered with bubble solution. In its most simple form, the leaves 20 are immersed into a bath or reservoir of bubble solution. The second rim 16 is rotated in an opposite direction to move the leaves 20 outward and at least partially open the central aperture 18 which forms a bubble film across the opening of the aperture 18. An air supply is supplied by either blowing across the bubble film, waving the mechanism 12, or using a mechanical air generator to create bubbles.

The user can alter the size of a single bubble film by increasingly expanding the leaves 20 outward from the central aperture 18. This in turn produces bubbles of varying sizes from very small bubbles when a small aperture is created to a large bubble when the leaves 20 are fully expanded so that the bubble film covers the entire central aperture 18. Multiple bubble films, and thus bubbles, can also be created due to secondary apertures 32 formed between the leaves 20 as they are expanded outwardly.

Figure 2:
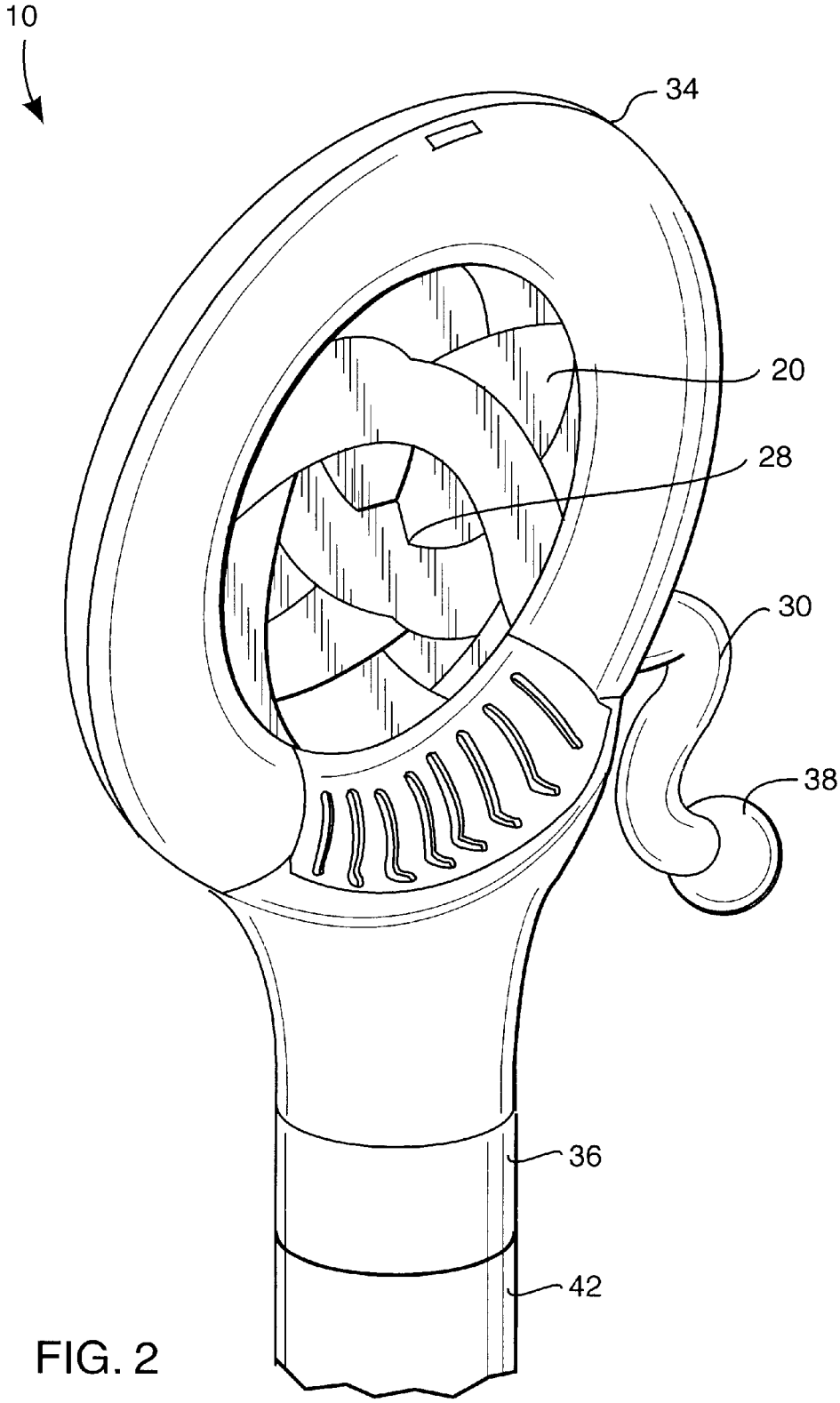
FIG. 2 is a fragmented perspective view of a bubble forming device incorporating the iris-like aperture mechanism of FIG. 1 and illustrating multiple leaves in a fully closed position.
Figure 3:
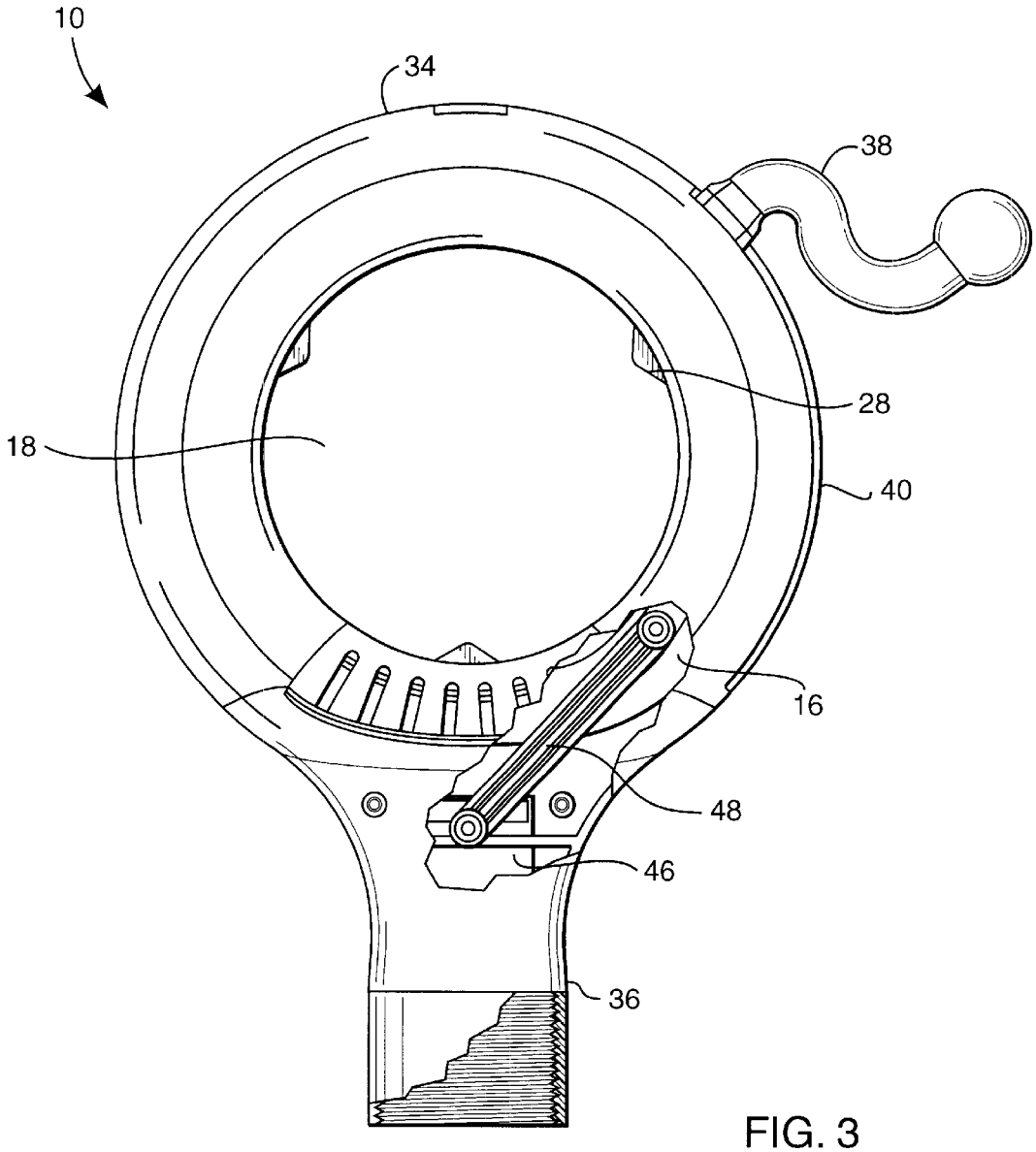
FIG. 3 is partially fragmented elevational view of the bubble forming device of FIG. 2, wherein the leaves are in a fully open position.
Figure 4:
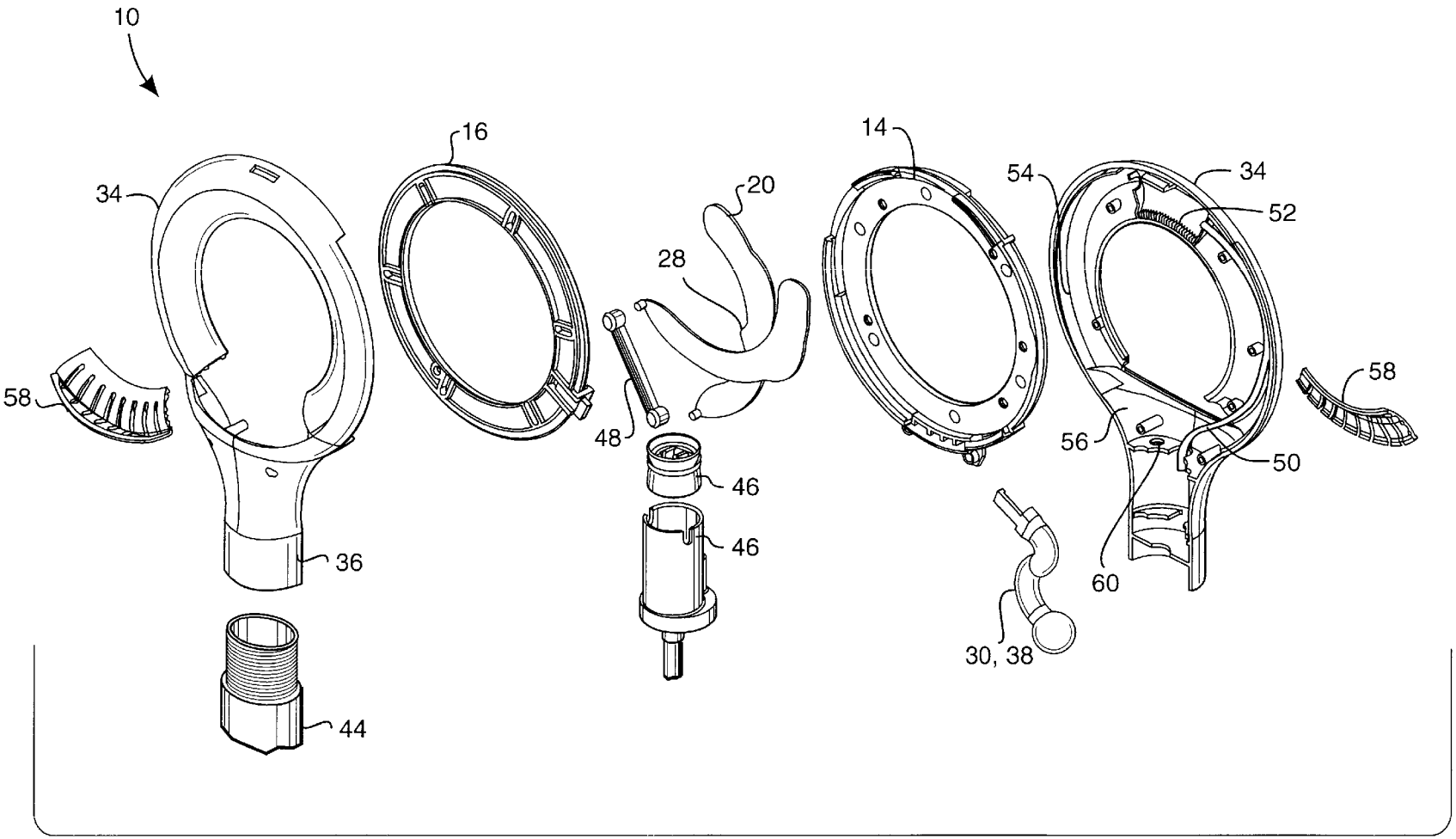
FIG. 4 is an exploded perspective view of the components of the bubble forming device of FIGS. 2 and 3.

FIGS. 2–4 illustrate the manner in which the iris-like leaf aperture mechanism 12 is incorporated into a hand-held device 10. As shown in FIG. 2, the device 10 is generally comprised of a housing 34 which at least partly encompasses the first and second rims 14 and 16 of the mechanism 12. The first rim 14 is typically fixedly attached to the housing 34. The housing 34 is connected to or forms a handle 36. The actuator 30 is in the form of a push and pull lever 38, although not limited to such, which is connected to an outer edge of the second rim 16 and extends through a slot 40 of the housing 34. When the lever 38 is fully actuated the leaves 20 are either in the closed position, as illustrated in FIG. 2, or in the fully opened position, illustrated in FIG. 3. The leaves 20 may be immersed into an external reservoir of bubble solution to form bubbles, as described above.

More preferably, the device 10 includes an internal reservoir 42 either built into the hollow handle 36 or comprised of a bottle of bubble solution 44 threadably received by the handle 36. As illustrated in FIGS. 3 and 4, a pump 46 is built into the handle 36 and in fluid communication with the reservoir 42. As the actuator 30, in this case the lever 38, is triggered the pump 46 is activated. In the illustrated preferred embodiment, a piston rod 48 is pivotally interconnected between a point on the second rim 16 and the pump 46. As the second rim 16 is rotated, the piston rod 48 pivotally moves upwardly and downwardly depending on the rotation of the second rim 16 and activates the pump 46, causing the pump 46 to discharge bubble solution from the reservoir 42 and through a tube 50.

The bubble solution is ejected from the tube 50 preferably near the apex of the first and second rims 14 and 16 and onto the leaves 20. The solution flows over the leaves 20, and a series of ridges 52 formed within the housing 34 may be used to facilitate the uniform dispersion of the solution over the leaves 20. The pump 46 can be designed to discharge the bubble solution on either an upward or downward pull of the piston rod 48, or both. Preferably, the discharge is timed to coincide with the full closure of the leaves 20 to facilitate bubble film production.

After the bubble solution has flowed over the closed leaves 20, the lever 38 is actuated and the leaves 20 are moved outward. The overlapping leaves 20 frictionally pull apart from one another and create a bubble film in the ever expanding central aperture 18. The leaves 20 are moved to a desired position and an air stream is supplied to form bubbles, as described above. The housing 34 is designed to form an outer gravity fed channel 54 which captures the excess bubble solution which flows off of the first and second rims 14 and 16 and leaves 20. The channel 54 feeds the excess solution to a basin 56 formed in the base of the housing 34. The basin 56 may be of such a volume that when the device 10 is laid down horizontally flat no excess fluid flows out from the device 10. Grated inserts 58 may be used as part of the housing 34 to facilitate capture of the excess bubble solution into the basin 56 and also for aesthetic purposes. Preferably, the basin 56 includes at least one valve 60 which filters the excess bubble solution back into the reservoir 42. The valve 60 preferably comprises a one-way valve so that solution can enter into the reservoir 42 through the basin 56 but the solution cannot escape the reservoir 42 through the valve 60. The design of the housing 34 is such that it also captures excess bubble solution. In fact, the combination of the design of the housing 34, the volume of the basin 56, and the use of the valve 60 allow the user to invert the device 10 without any liquid bubble solution spilling out of the device 10. By capturing the excess bubble solution, more bubbles can be produced due to the conservation and reuse of the bubble solution. Messiness commonly associated with prior art bubble forming apparatuses is also avoided. Although one embodiment has been described in detail for purposes of illustration, various modifications may be made without departing from the scope and spirit of the invention. Accordingly, the invention is not to be limited, except as by the appended claims.

What is claimed is:

1. A bubble forming device, comprising:

aligned first and second rims which cooperatively define a central bubble-forming aperture for the device;

an actuator for rotatably moving the second rim relative to the first rim;

a plurality of leaves each having a first end pivotally attached to the first rim and a second end pivotally attached to the second rim, wherein the leaves are configured so as to selectively move into and out of the central bubble-forming aperture as the second rim is moved relative to the first rim; and a bubble solution reservoir in selective fluid communication with the aligned first and second rims, whereby bubble solution is dispensed to the leaves.

2. The device of claim 1, wherein the actuator comprises a lever connected to an outer edge of the second rim.

3. The device of claim 2, wherein the first rim is stationary.

4. The device of claim 2, wherein the leaves have a generally arcuate configuration.

5. The device of claim 4, wherein at least one of the leaves includes a protrusion which aids in closing the central aperture.

6. The device of claim 4, wherein multiple secondary apertures are formed within the central aperture as the leaves are moved into the central bubble-forming aperture.

7. The device of claim 1, including a pump in fluid communication with the bubble solution reservoir for dispensing bubble solution to the leaves.

8. The device of claim 7, wherein the pump is connected to the actuator such that when the actuator rotatably moves the second rim the pump is activated to discharge bubble solution onto the leaves.

9. The device of claim 7, including tubing connected to the pump for directing the bubble solution to a predetermined point on the first and second rims allowing the bubble solution to be dispensed onto the leaves.

10. The device of claim 7, including a handle which houses the bubble solution reservoir.

11. The device of claim 10, wherein the bubble solution reservoir comprises a bottle of bubble solution secured to the handle.

12. The device of claim 1, including a housing which partially encases the first and second rims.

13. The device of claim 12, wherein the housing defines a channel which directs excess bubble solution to a basin formed at a base of the housing.

14. The device of claim 13, wherein the basin includes at least one valve for draining the excess bubble solution to the reservoir.

15. The device of claim 1, wherein the first and second rims form a recess capable of at least partially containing the leaves when the leaves are moved to a fully expanded position.

16. A bubble forming device, comprising:

aligned first and second rims which cooperatively define a central bubble-forming aperture;

a housing which at least partially encases the first and second rims, wherein the first rim is securely attached to the housing so as to be stationary;

an actuator for rotatably moving the second rim relative to the first rim;

a plurality of leaves each having a first end pivotally attached to the first rim and a second end pivotally attached to the second rim, the leaves having a generally arcuate configuration so as to selectively move into and out of the central bubble-forming aperture as the second rim is moved relative to the first rim, and at least one of the leaves having a protrusion which aids in closing the central aperture; and a pump connected to the actuator and in fluid communication with a bubble solution reservoir such that when the actuator rotatably moves the second rim, the pump is activated to discharge bubble solution to be dispensed onto the leaves.

17. The device of claim 16, wherein the actuator comprises a lever connected to an outer edge of the second rim.

18. The device of claim 16, wherein multiple secondary apertures are formed within the central aperture as the leaves are moved into the central bubble-forming aperture.

19. The device of claim 16, including tubing connected to the pump for directing the bubble solution to a predetermined point on the first and second rims allowing the bubble solution to be dispensed onto the leaves.

20. The device of claim 16, including a handle which houses the bubble solution reservoir.

21. The device of claim 20, wherein the bubble solution reservoir comprises a bottle of bubble solution secured to the handle.

22. The device of claim 16, wherein the housing defines a channel which directs excess bubble solution to a basin formed at a base of the housing, the basin having at least one valve for draining the excess bubble solution to the reservoir.

23. The device of claim 16, wherein the first and second rims form a recess capable of at least partially containing the leaves when the leaves are moved to a fully expanded position.

24. A method of forming bubbles, comprising the steps of:

providing a bubble forming device having aligned first and second rims which cooperatively define a central bubble-forming aperture, an actuator for rotatably moving the second rim relative to the first rim, and a plurality of leaves each having a first end pivotally attached to the first rim and a second end pivotally attached to the second rim;

triggering the actuator to cause the second rim to rotate relative to the first rim which results in the leaves moving into the central bubble-forming aperture;

dispensing bubble solution onto the leaves;

forming a bubble film within the bubble-forming aperture by at least partially moving the leaves out of the central bubble-forming aperture; and supplying an air stream to the bubble film to produce bubbles.

25. The method of claim 24, wherein the forming step includes the step of creating multiple secondary apertures within the central bubble-forming aperture as the leaves are at least partially moved out of the central bubble-forming aperture.

26. The method of claim 24, wherein the dispensing step includes the step of immersing the leaves in the bubble solution.

27. The method of claim 24, wherein the dispensing step includes the step of pumping the bubble solution from a bubble solution reservoir onto the leaves.

28. The method of claim 24, wherein the triggering step includes the step of pulling a lever connected to an edge of the second rim.

29. The method of claim 24, including the step of draining excess bubble solution from the first and second rims and the leaves into a bubble solution reservoir associated with the device.

30. A method of forming bubbles, comprising the steps of:

providing a bubble forming device having aligned first and second rims which cooperatively define a central bubble-forming aperture, a lever connected to an outer edge of the second rim for rotatably moving the second rim relative to the first rim, and a plurality of leaves each having a first end pivotally attached to the first rim and a second end pivotally attached to the second rim;

pulling the lever to cause the second rim to rotate relative to the first rim which results in the leaves moving into the central bubble-forming aperture;

dispensing bubble solution onto the leaves by pumping bubble solution from a bubble solution reservoir associated with the device onto the leaves;

draining excess bubble solution from the first and second rims and leaves into the bubble solution reservoir;

forming a bubble film within the bubble-forming aperture by at least partially moving the leaves out of the central bubble-forming aperture; and supplying an air stream to the bubble film to produce bubbles.

* * * * *